United States Patent [19]

Breslow

[11] 4,042,432

[45] Aug. 16, 1977

[54] DESENSITIZER FOR N-PROPYL NITRATE

[75] Inventor: B. Arthur Breslow, Ridgecrest, Calif.

[73] Assignee: The United States of America as represented by the Secretary of the Navy, Washington, D.C.

[21] Appl. No.: 749,935

[22] Filed: Dec. 13, 1976

[51] Int. Cl.[2] ..... C06B 25/36

[52] U.S. Cl. ..... 149/89; 149/88; 149/108.8

[58] Field of Search ..... 149/89, 88, 108.8

[56] References Cited

U.S. PATENT DOCUMENTS

| | | | |
|---|---|---|---|
| 2,914,910 | 12/1959 | King | 149/88 X |
| 3,116,187 | 12/1963 | Scanlon et al. | 149/89 X |

*Primary Examiner*—Stephen J. Lechert, Jr.
*Attorney, Agent, or Firm*—R. S. Sciascia; Roy Miller; Lloyd E. K. Pohl

[57] ABSTRACT

A low gamma gas is dissolved in n-propyl nitrate for desensitization purposes.

7 Claims, No Drawings

DESENSITIZER FOR N-PROPYL NITRATE

BACKGROUND OF THE INVENTION

1. Field of the Invention.

This invention relates to densensitized n-propyl nitrate and to a method for accomplishing such densensitization.

2. Description of the Prior Art n-Propyl nitrate is a highly explosive material. As such, it has many potential uses. For example, it would be an excellant material for use in fuel air explosive warheads. It is a liquid which could be readily dispersed in the air as a cloud of droplets and detonated. However, the potential of n-propyl nitrate has not been realized.

The reason for its failure to find use is its unacceptable shock sensitivity. If a container of n-propyl nitrate is accidently dropped, bubbles, which are naturally present due to handling, undergo adiabatic compression. From the gas law, $P = nRT/V$, one may readily discern what occurs when adiabatic compression of a bubble takes place. When a container of n-propyl nitrate which contains bubbles is roughly handled, considerable pressure is applied to the bubble. When P (pressure) on a bubble increases because of this rough handling, the V (volume) of the bubble remains fairly constant, i.e., decreases only a small amount. In order for the equation to balance, T (temperature) must increase. (R and $n$ are, of course, constants.) The hot gas present in the bubble because of this temperature rise causes the n-propyl nitrate surrounding the bubble to decompose leading to initiation of a detonation.

SUMMARY OF THE INVENTION

According to this invention, n-propyl nitrate is rendered insensitive to shock, i.e., is desensitized, by means of a low gamma gas. The low gamma gas is incorporated into the n-propyl nitrate in an amount sufficent to assure that when bubbles are formed the vapor within them will be substantially low gamma gas. For purposes of this invention, a low gamma gas is defined as one having a ratio, i.e., a gamma, of 1.15 or less. Gamma is the ratio of specific heat at constant pressure to specific heat at constant volume.

DESCRIPTION OF THE PREFERRED EMBODIMENTS

There are, of course, many low gamma gases, i.e., many gases having gamma values (ratios of specific heat at constant pressure to specific heat at constant volume) of 1.15 oar less. Among them are such common, readily available gasses as butane, propane, chloroform, ethyl ether and methyl ether. Any of these materials are suitable for use in the practice of this invention.

To render n-propyl nitrate safe for use, i.e., desensitized, low gamma gas is dissolved in the n-propyl nitrate. The desensitized solution should contain enough low gamma gas to insure that any bubbles formed by handling will have a content which is substantially low gamma gas. A solution of low gamma gas in n-propyl nitrate which contains from about 1 to about 2 weight percent low gamma gas and a balance (99 to 98 weight percent) of n-propyl nitrate will be desensitized. However, an excess of low gamma gas will hurt nothing. On the other hand, bubbles need not contain only low gamma gas. That is, desensitization will occur even if bubbles formed on handling are only partially filled with low gamma gas.

If one, for some reason, wishes to limit the amount of gas dissolved to the least amount possible, the amount disolved will, of course, depend upon the boiling point of the gas. The lower the boiling point of the gas, the higher the vapor pressure will be and the higher the vapor presssure is, the less the amount needed to desensitize will be.

Techniques for dissolving gases in liquids are, of course, well known. Any such technique is suitable for use in this invention.

In addition to desensitizing n-propyl nitrate, low gamma gases may be used to desensitize solid explosives. Solid explosives are sometimes initiated by hot gases in voids left by manufacturing processes, shrinkage or the like. All that is required for desensitization is that the projectile or other container in which the solid explosive and gas are located be sealable with a gas tight seal to prevent the gas from escaping once it is introduced. If low gamma gas is incorporated into a solid explosive it will eliminate in barrel explosions which sometimes occur due to pressure on voids and the like when explosive projectiles are subjected to set back forces when they are fired from guns.

What is claimed is:

1. A composition of matter comprising a solution of low gamma gas in n-propyl nitrate,, said low gammma gas having a gamma value of 1.15 or less.

2. A composition of matter according to claim 1 wherein said solution contains from about 1 to about 2 weight percent low gamma gas.

3. A composition of matter acording to claim 2 wherein said low gamma gas is selected from the group consisting of butane, propane, chloroform, ethyl ether and methyl ether.

4. A method for desensitizing n-propyl nitrate comprising the steps of:

A. obtaining n-propyl nitrate and a low gamma gas; and

B. dissolving said low gamma gas in said n-propyl nitrate to form a solution.

5. A method according to claim 4 wherein said low gamma gas is dissolved in an amount sufficient to make up from about 1 to about 2 weight percent of said solution.

6. A method according to claim 5 wherein said low gamma gas is selected from the group consisting of butane, propane, chloroform, ethyl ether and methyl ether.

7. A method for desensitizing a solid explosive comprising the steps of:

a. placing solid explosive and a gas having a gamma value of 1.15 or less in a container; and b. sealing the container with a gas tight seal.

* * * * *